US010767957B2

(12) United States Patent
McPherson et al.

(10) Patent No.: US 10,767,957 B2
(45) Date of Patent: Sep. 8, 2020

(54) COMPOUND BOW WITH SERVICING STRINGS

(71) Applicant: MCP IP, LLC, Sparta, WI (US)

(72) Inventors: Mathew A. McPherson, Norwalk, WI (US); Mark J. Hayes, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 158 days.

(21) Appl. No.: 15/924,053

(22) Filed: Mar. 16, 2018

(65) Prior Publication Data

US 2018/0266786 A1 Sep. 20, 2018

Related U.S. Application Data

(60) Provisional application No. 62/473,155, filed on Mar. 17, 2017.

(51) Int. Cl.
*F41B 5/14* (2006.01)
*F41B 5/10* (2006.01)

(52) U.S. Cl.
CPC ..... *F41B 5/1449* (2013.01); *F41B 5/105* (2013.01)

(58) Field of Classification Search
CPC ..... F41B 5/1449; F41B 5/14; F41B 5/105
See application file for complete search history.

(56) References Cited

U.S. PATENT DOCUMENTS 3,294,078 A 12/1966 Allen
3,416,220 A 12/1968 Wilson
4,032,111 A * 6/1977 Garrett ..... F16G 11/12 254/256
4,074,409 A 2/1978 Smith
4,077,385 A * 3/1978 Fredrickson ..... F41B 5/10 124/25.6
4,291,452 A * 9/1981 Whitman, Sr. ..... F41B 5/1449 124/23.1
4,599,987 A 7/1986 Rezmer
4,846,142 A 7/1989 Tone
5,125,389 A 6/1992 Paff
5,425,350 A 6/1995 Egusquiza
5,606,963 A 3/1997 Wenzel et al.
5,746,192 A 5/1998 Gissel
6,957,647 B2 10/2005 Evans et al.
7,089,923 B2 8/2006 Johnson
7,980,235 B1 * 7/2011 Kronengold ..... F41B 5/14 124/1
2011/0146644 A1 6/2011 Achkar
2013/0125871 A1 * 5/2013 Pirillo ..... F41B 5/1449 124/86
2013/0205557 A1 8/2013 MacArthur
2014/0069407 A1 3/2014 Barrios
2016/0033228 A1 2/2016 McPherson

* cited by examiner

*Primary Examiner* — Jun S Yoo

(57) ABSTRACT

In some embodiments, a method comprises attaching a servicing string to the first rotatable member and the second rotatable member of a compound archery bow. The servicing string retains the first rotatable member and the second rotatable member in a non-brace orientation, for example in a partially drawn orientation. The bowstring is removed from the compound archery bow. A servicing cable is attached to the first rotatable member and the second rotatable member, and the servicing string is detached from at least one of the first rotatable member or the second rotatable member. The servicing cable is let down, unloading the compound archery bow.

19 Claims, 12 Drawing Sheets

COMPOUND BOW WITH SERVICING STRINGS

CROSS-REFERENCE TO RELATED APPLICATIONS

This application claims the benefit of U.S. Patent Application No. 62/473,155, filed Mar. 17, 2017, the entire content of which is hereby incorporated herein by reference.

BACKGROUND OF THE INVENTION

This invention relates generally to archery bows and more specifically to compound archery bows.

Compound bows are known in the art. Compound bows often include rotating members, a bowstring and at least one cable segment.

Servicing and maintenance of compound bows often requires a bow press, which tends to be a large machine capable of flexing the limbs of the bow to relieve tension from the bowstring and cable segments. Bow presses are often required in order to change bowstring and cable segments, to change cam track modules on rotatable members, etc.

There remains a need for novel archery bow designs that allow for servicing and maintenance of a compound bow without the need for a bow press.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a method comprises attaching a servicing string to the first rotatable member and the second rotatable member of a compound archery bow. The servicing string retains the first rotatable member and the second rotatable member in a non-brace orientation, for example in a partially drawn orientation. The bowstring is removed from the compound archery bow. A servicing cable is attached to the first rotatable member and the second rotatable member, and the servicing string is detached from at least one of the first rotatable member or the second rotatable member. The servicing cable is let down, unloading the compound archery bow. In some embodiments, letting down the servicing cable comprises rotating the first rotatable member and second rotatable member past their orientations in a brace condition.

In some embodiments, a power cable is removed from the archery bow. In some embodiments, a replacement power cable is installed on the archery bow.

In some embodiments, the servicing string is reinstalled on the bow and the servicing cable is removed.

In some embodiments, a replacement bowstring is installed on the bow and the servicing string is removed.

In some embodiments, a kit comprises a compound archery bow, a servicing string and a servicing cable. The bow comprises a first rotatable member, a second rotatable member and a bowstring. The servicing string is arranged to engage the first rotatable member and the second rotatable member. A length of the servicing string is less than a length of the bowstring. The servicing cable is arranged to engage the first rotatable member and the second rotatable member. A length of the servicing string is greater than the length of the bowstring.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
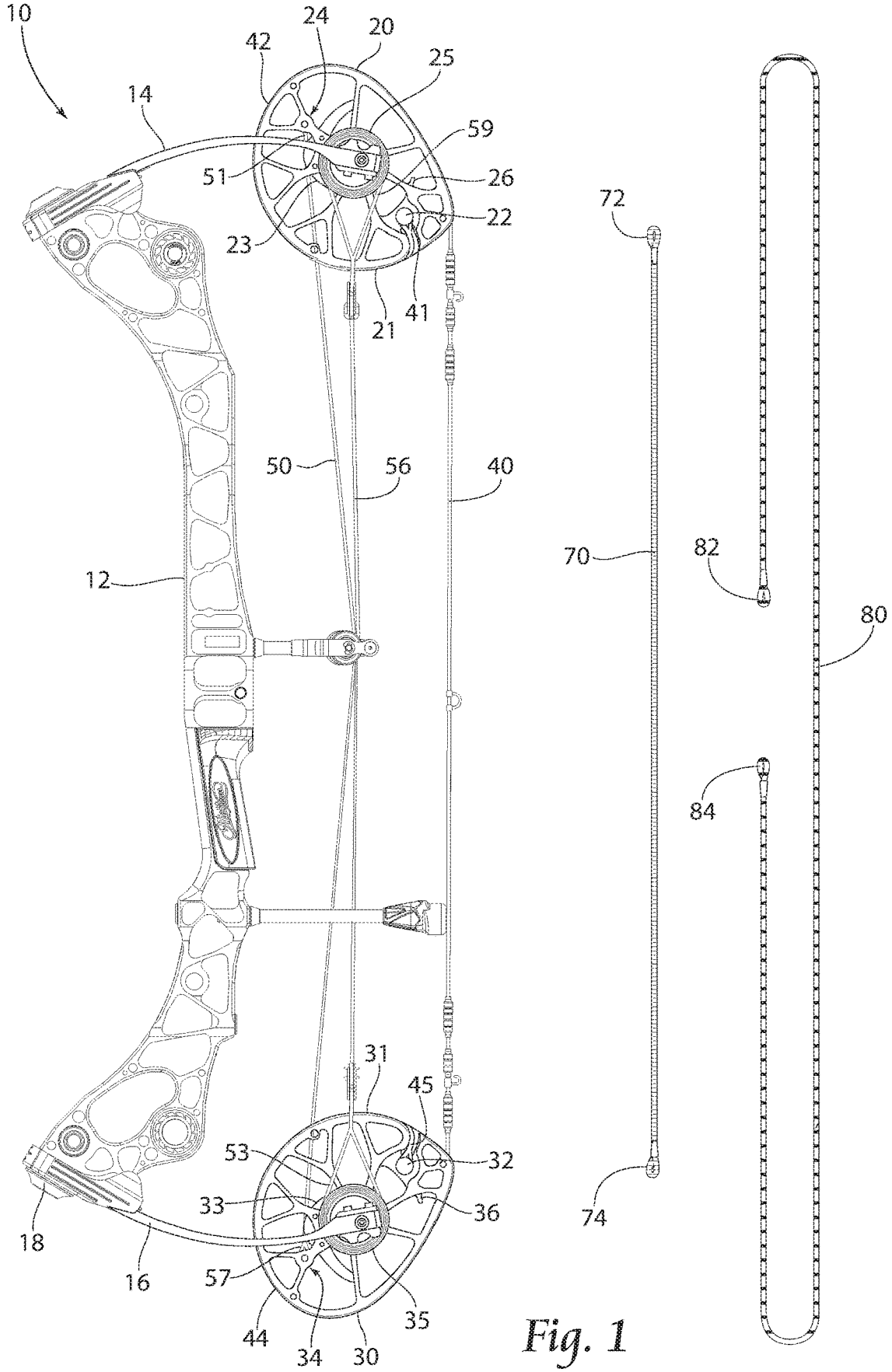
FIG. 1 shows an embodiment of a compound bow with an embodiment of a servicing string and an embodiment of a servicing cable.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 comprising a first rotatable member 20, a second rotatable member 30, a bowstring 40 and at least one power cable 50.

In some embodiments, an archery bow 10 comprises a riser 12, a first limb 14 supported by the riser 12 and a second limb 16 supported by the riser 12. In some embodiments, the first limb 14 supports the first rotatable member 20 and the second limb 16 supports the second rotatable member 30.

In some embodiments, the first rotatable member 20 comprises a first bowstring track 21 and a first bowstring terminal 22. In some embodiments, the second rotatable member 30 comprises a second bowstring track 31 and a second bowstring terminal 32. In some embodiments, the bowstring 40 is attached between the rotatable members 20, 30. In some embodiments, the bowstring 40 comprises a first end 41 comprising a loop and a second end 45 comprising a loop. In some embodiments, the first end 41 of the bowstring 40 is attached to the first bowstring terminal 22, and the bowstring 40 comprises a first wrapped portion 42 oriented in the first bowstring track 21, for example when the bow 10 is in a brace condition. In some embodiments, the second end 45 of the bowstring 40 is attached to the second bowstring terminal 32, and the bowstring 40 comprises a second wrapped portion 44 oriented in the second bowstring track 31, for example when the bow 10 is in a brace condition.

In some embodiments, the first rotatable member 20 comprises a first cam track 23, and the first power cable 50 is arranged to be taken up by the first cam track 23 as the bow 10 is drawn. In some embodiments, the first rotatable member 20 comprises a first power cable terminal 24. In some embodiments, a first end 51 of the first power cable 50 is attached to the first power cable terminal 24, and the first power cable 50 extends toward the second rotatable member 30. In some embodiments, the first power cable 50 attaches to the second rotatable member 30, although the first power cable 50 can also attach to an axle, to the second limb 16, or any other suitable portion of the bow 10. As shown in FIG. 1, the second rotatable member 30 comprises a first force vectoring anchor 35, and a second end 53 of the first power cable 50 is attached to the first force vectoring anchor 35.

In some embodiments, the archery bow 10 comprises a second power cable 56. In some embodiments, the second rotatable member 30 comprises a second cam track 33, and the second power cable 56 is arranged to be taken up by the second cam track 33 as the bow 10 is drawn. In some embodiments, the second rotatable member 30 comprises a second power cable terminal 34. In some embodiments, a first end 57 of the second power cable 56 is attached to the second power cable terminal 34, and the second power cable 56 extends toward the first rotatable member 20. In some embodiments, the second power cable 56 attaches to the first rotatable member 20, although the second power cable 56 can also attach to an axle, to the first limb 14, or any other suitable portion of the bow 10. As shown in FIG. 1, the first rotatable member 20 comprises a second force vectoring anchor 25, and a second end 59 of the second power cable 56 is attached to the second force vectoring anchor 25.

In some embodiments, the first rotatable member 20 comprises a first servicing post 26. In some embodiments, the second rotatable member 30 comprises a second servicing post 36. A servicing post 26, 36 can have any suitable size, shape or configuration. In some embodiments, a servicing post 26, 36 comprises a stem and an enlarged flange portion.

In some embodiments, a servicing string 70 is provided with the bow 10. In some embodiments, a servicing string 70 comprises a tool that allows a user to change a bowstring 40 without any other tools. In some embodiments, a length of the servicing string 70 is less than a length of the bowstring 40. In some embodiments, the first end 72 of the servicing string 70 is arranged to engage the first rotatable member 20 and the second end 74 of the servicing string 70 is arranged to engage the second rotatable member 30. In some embodiments, each end 72, 74 comprises a hook, a loop, or another suitable shape. In some embodiments, the first end 72 of the servicing string 70 is arranged to engage the first servicing post 26 and the second end 74 of the servicing string 70 is arranged to engage the second servicing post 36.

In some embodiments, a length of the servicing string 70 is less than a distance between the first servicing post 26 and the second servicing post 36 when the bow 10 is in the brace condition.

The servicing string 70 can be made of any suitable material and can have any suitable configuration. In some embodiments, the servicing string 70 acts as a tension member when used to service the bow 10. In some embodiments, the servicing string 70 comprises a material similar to the material of the bowstring 40, such as a polymeric material or materials disclosed in U.S. Pat. No. 7,231,915, the entire disclosure of which is hereby incorporated herein by reference.

In some embodiments, the servicing string 70 is made to be as small, light and compact as possible. In some embodiments, the servicing string 70 consists of polymeric material. In some embodiments, the servicing string 70 consists of a body length of cable and end loops 72, 74.

In some embodiments, a servicing cable 80 is provided with the bow 10. Desirably, a length of the servicing cable 80 is greater than the length of the bowstring 40. In some embodiments, the first end 82 of the servicing cable 80 comprises a loop or other structure suitable to engage a rotatable member 20, and the second end 84 comprises a loop or other structure suitable to engage a rotatable member 30. In some embodiments, the first end 82 is arranged to engage the first bowstring terminal 22 and the second end 84 is arranged to engage the second bowstring terminal 32.

In some embodiments, a servicing cable 80 comprises materials similar to the servicing string 70. In some embodiments, the servicing cable 80 consists of polymeric material. In some embodiments, the servicing cable 80 consists of a body length of cable and end loops 82, 84.

In some embodiments, a method comprises using a servicing string 70 to remove the bowstring 40 of the bow 10. In some embodiments, the method further comprises installing a replacement bowstring 40 on the bow 10.

In some embodiments, a method comprises using a servicing cable 80 to remove one or more power cables 50, 56. In some embodiments, the servicing cable 80 is used to unwind the rotatable members 20, 30, thereby dissipating stored energy in a controlled manner and relaxing the limbs 14, 16. When the bow 10 is at or near a relaxed condition, the power cable(s) 50, 56 can be removed from the bow 10. In some embodiments, the method further comprises installing one or more replacement cable(s) 50, 56 on the bow 10. In some embodiments, the method further comprises loading the limbs 14, 16 and returning the bow 10 to its brace condition.

FIGS. 2-9 illustrate a sequence of using a servicing string 70 to change a bowstring 40 and using a servicing cable 80 to change a power cable 50.

Figure 2:
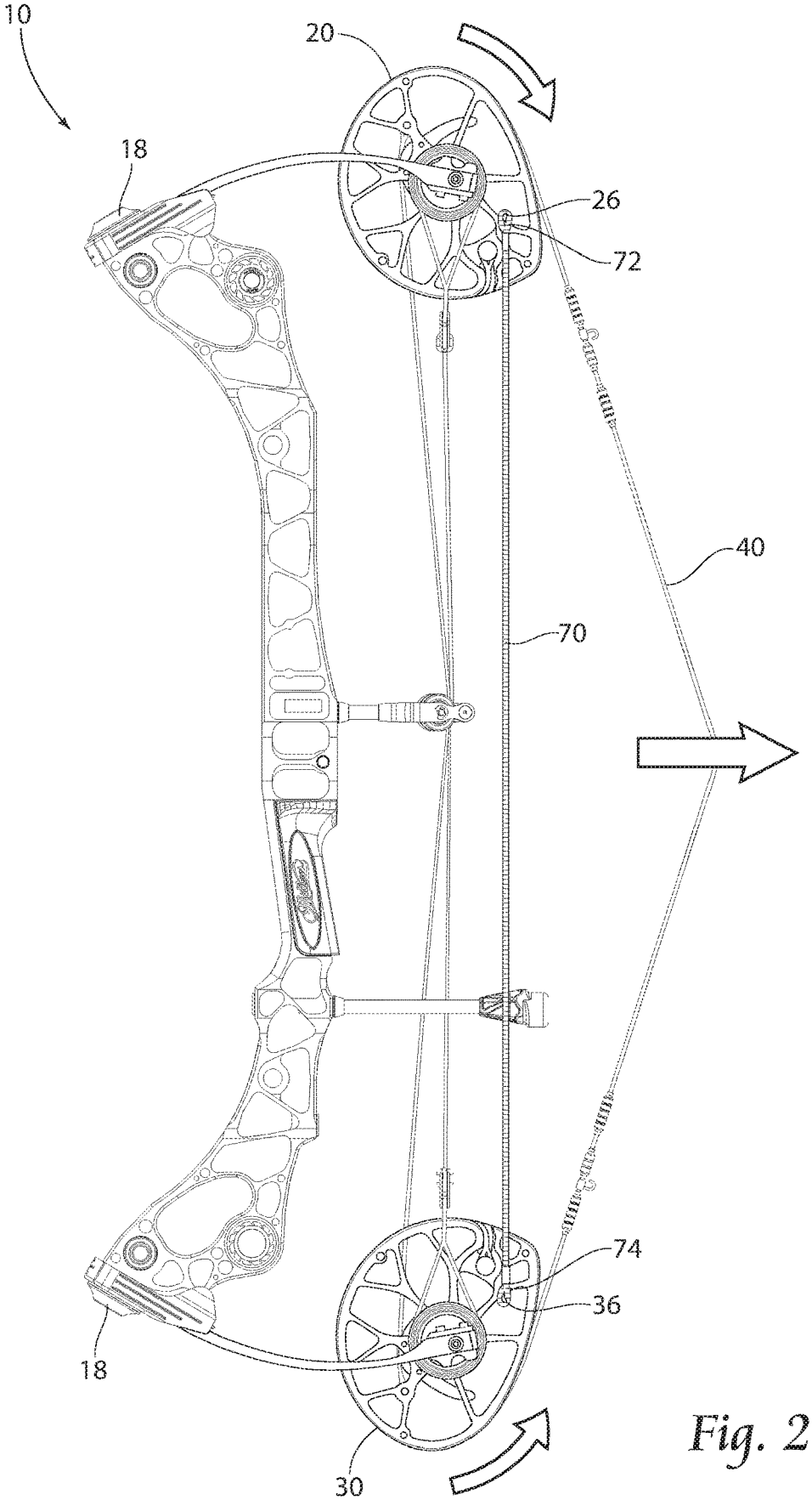
FIGS. 2 and 3 show a bowstring being removed from an archery bow using a servicing string.

FIG. 2 shows an embodiment of a servicing string 70 attached between servicing posts 26, 36 of the rotatable members 20, 30.

In some embodiments, the limb fasteners 18 can be backed out as far as possible without removing the limb fasteners 18, to reduce the loading on the limbs.

In some embodiments, a method comprises providing a bow 10 and attaching a servicing string 70 between the rotatable members 20, 30. In some embodiments, from a brace condition of the bow 10, the bowstring 40 can be pulled to orient the bow 10 in a partially drawn condition, wherein the rotatable members 20, 30 are advanced rotationally from their brace orientations. The servicing string 70 can be attached between the rotatable members 20, 30, for example by attaching the first end 72 to the first servicing post 26 and attaching the second end 74 to the second servicing post 36. When the servicing string 70 is properly installed, any force being applied to the bowstring 40 in the direction of draw can be removed. In some embodiments, the servicing string 70 will be placed in tension, thereby retaining the rotatable members 20, 30 in a slightly drawn orientation. The bowstring 40 is no longer in tension and can be removed from the bow 10.

Figure 3:
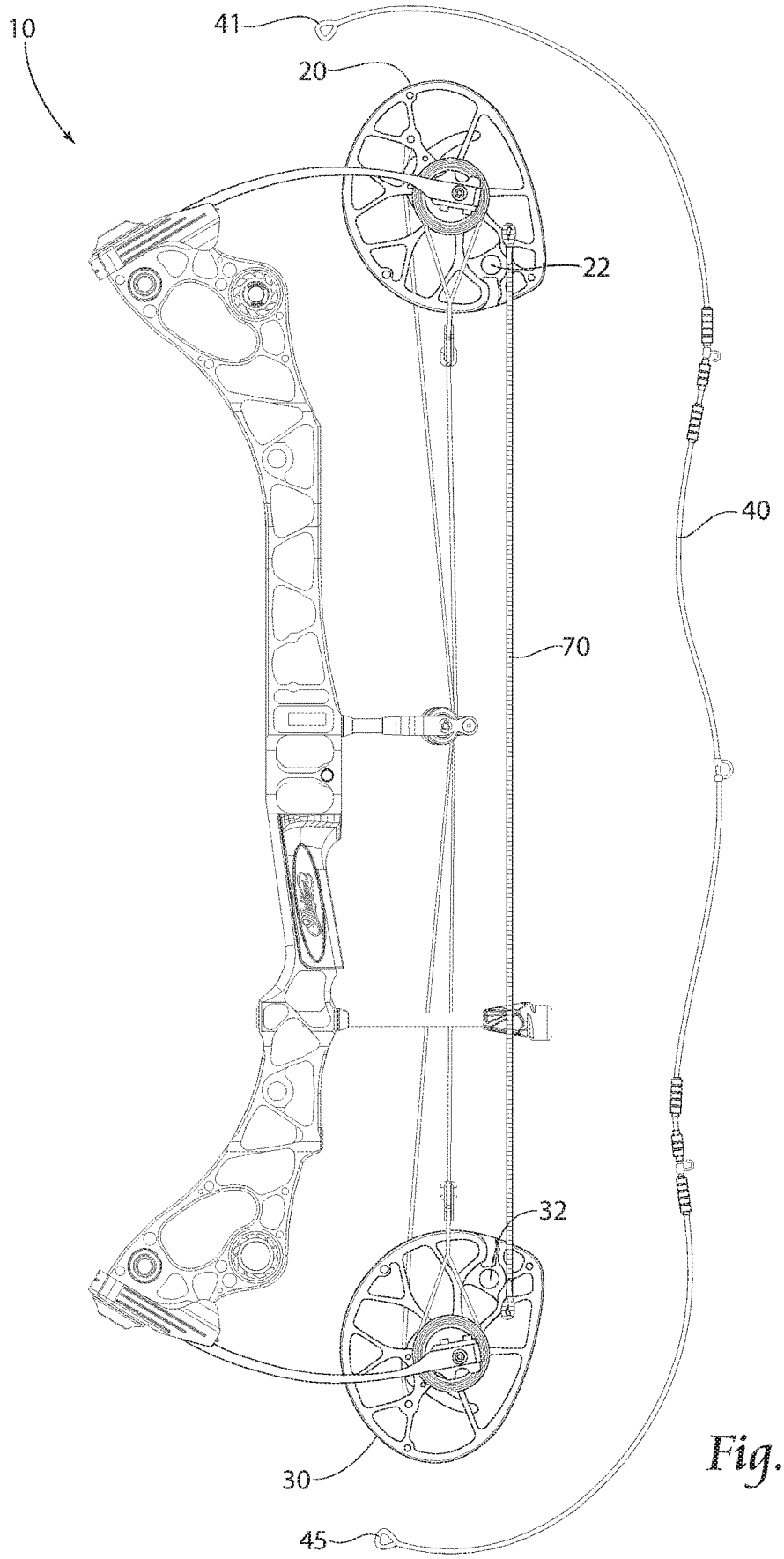

FIG. 3 shows the bow 10 of FIG. 2 with the bowstring 40 removed from the bow 10. The servicing string 70 is retaining the rotatable members 20, 30 is a slightly drawn orientation. In some embodiments, the first end 41 of the bowstring 40 is detached from the first bowstring terminal 22 and the second end 45 of the bowstring 40 is detached from the second bowstring terminal 32. The bowstring 40 can be detached completely from the rotatable members 20, 30 and removed from the bow 10.

At this point, in some embodiments, another bowstring 40 can be installed on the bow 10 and the servicing string 70 can be removed. Alternatively, if changing a power cable 50, 56 is desired, the servicing string 70 can remain attached between the rotatable members 20, 30, and the servicing cable 80 can be used.

Figure 4:
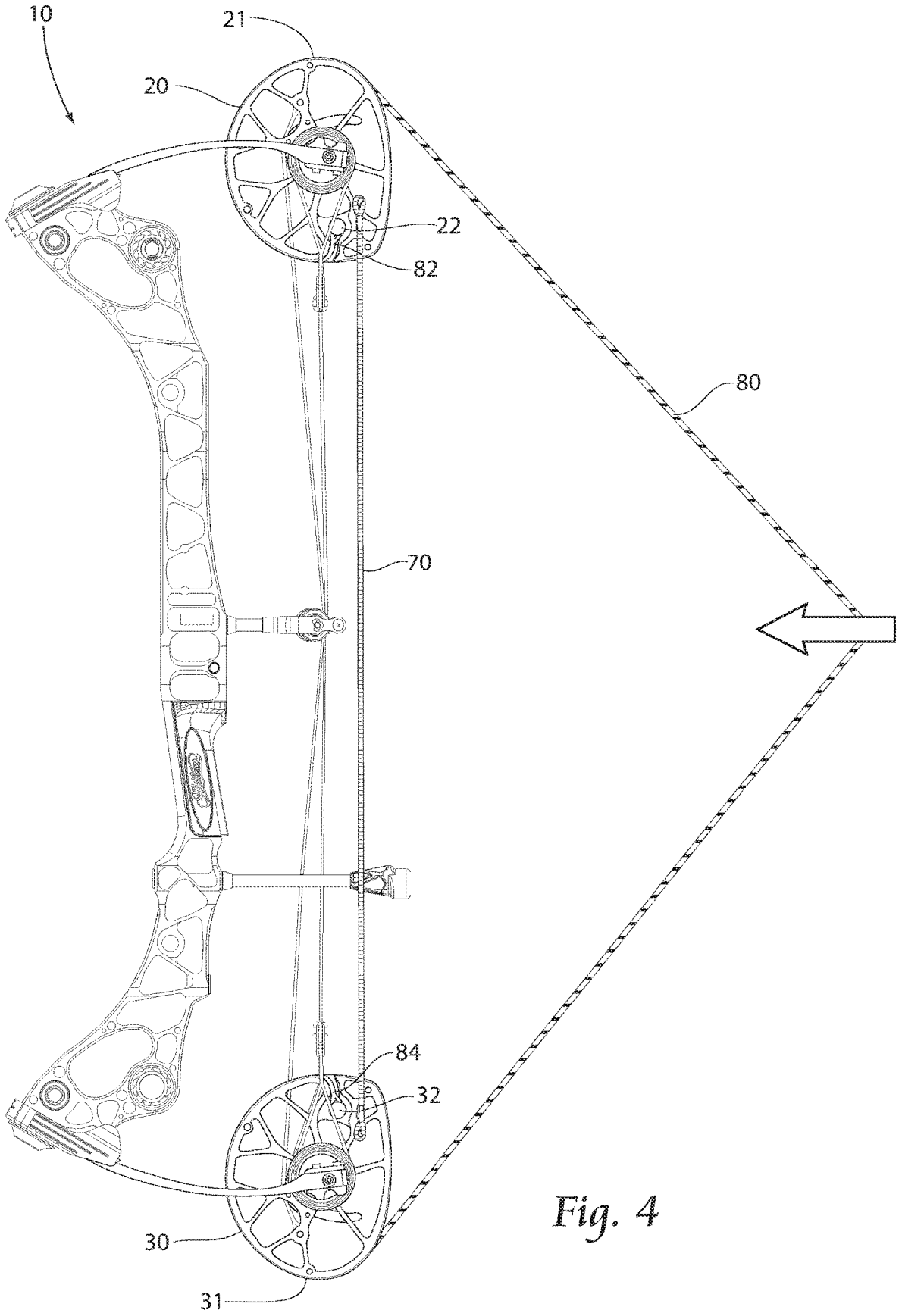
FIGS. 4-8 show a procedure for removing power cables from a bow using a servicing cable.

FIG. 4 shows the bow 10 of FIG. 3 with an embodiment of a servicing cable 80 attached to the rotatable members 20, 30. The servicing string 70 is still under tension and retaining the rotatable members 20, 30 in a fixed orientation.

In some embodiments, the servicing cable 80 is longer than the bowstring 40. In some embodiments, the servicing cable 80 is installed in place of the bowstring during the servicing operation. In some embodiments, the first end 82 of the servicing cable 80 is attached to the first bowstring terminal 22 of the first rotatable member 20 and a length portion of the servicing cable 80 is oriented in the first bowstring track 21. In some embodiments, the second end 84 of the servicing cable 80 is attached to the second bowstring terminal 32 of the second rotatable member 30 and a length portion of the servicing cable 80 is oriented in the second bowstring track 31.

When the servicing cable 80 is properly installed between the rotatable members 20, 30, the servicing cable 80 can act as a bowstring and be used to apply a draw force to the rotatable members 20, 30. Forces applied by the servicing cable 80 can rotate the rotatable members 20, 30 and relieve tension in the servicing string 70, and the servicing string 70 can be detached from at least one of the rotatable members 20, 30.

Figure 5:
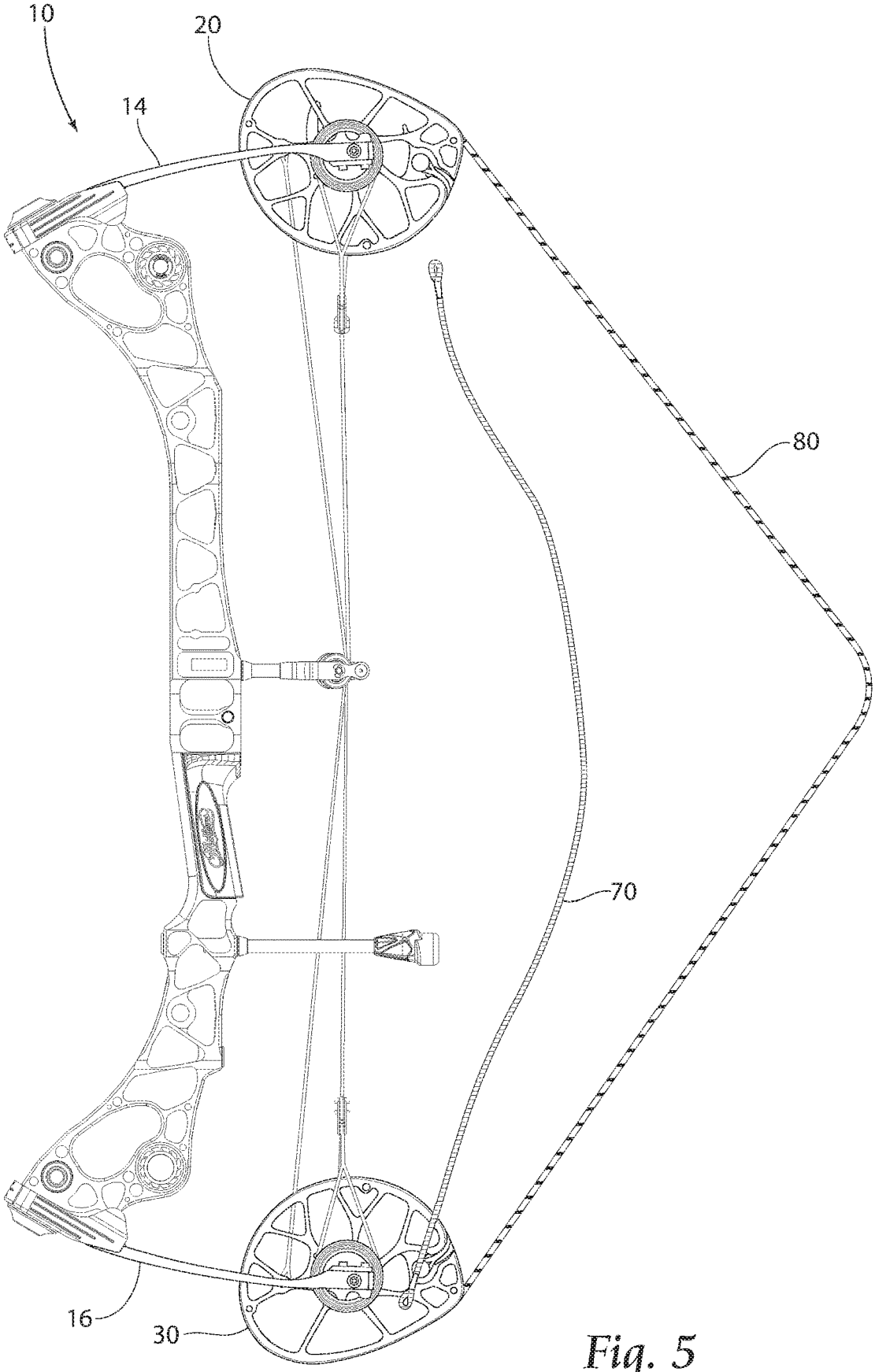

FIG. 5 shows the bow 10 of FIG. 4 with the servicing string 70 detached from the first rotatable member 20. The servicing string 70 no longer biases the rotatable members 20, 30, and a force applied to the servicing cable 80 is used to counteract energy stored in the bow 10. The servicing cable 80 can be let down in a controlled manner, allowing the rotatable members 20, 30 rotate back to the brace orientation, and then past the brace orientation to unwind and unload the bow 10.

In FIG. 5, the rotatable members 20, 30 have rotated past their brace condition orientation and the limbs 14, 16 are less flexed than in the brace condition. The length of the servicing cable 80 allows the rotatable members 20, 30 to unwind further as the servicing cable 80 is let down.

Figure 6:
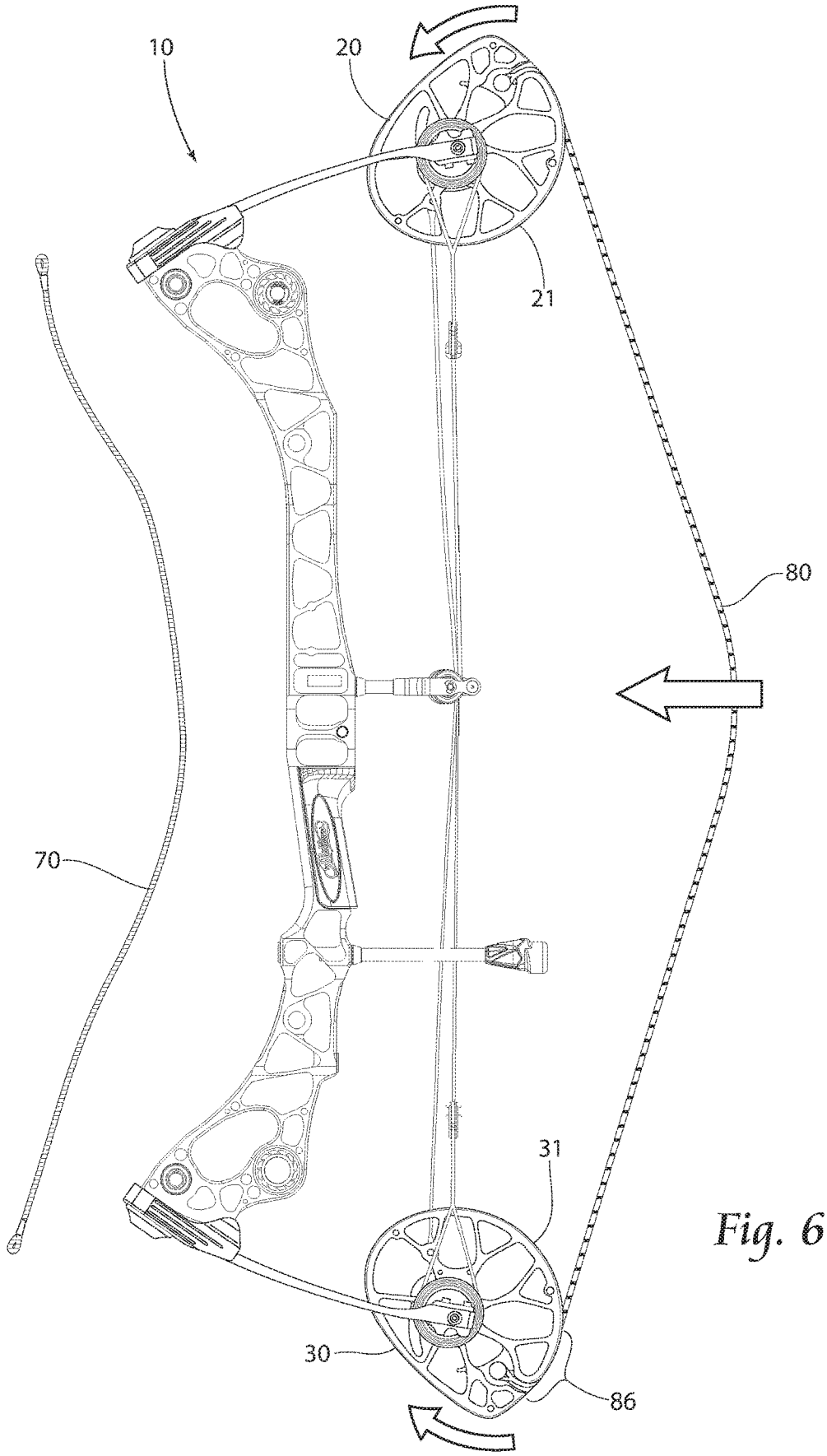

FIG. 6 shows the bow 10 of FIG. 5 with the servicing cable 80 almost fully let down. The limbs 14, 16 have straightened and relaxed. In some embodiments, the servicing cable 80 is wrapped around an entire perimeter of the first rotatable member 20 and the second rotatable member 30. In some embodiments, the bowstring tracks 21, 31 extend around an entire outer perimeter of the rotatable member 20, 30. In some embodiments, the servicing cable 80 wraps more than 360 degrees around the rotatable member 20, 30, and in some embodiments, a portion (e.g. 86) of the servicing cable 80 overlaps another portion of the servicing cable 80. In some embodiments, a depth of the bowstring track 21, 31 changes along its length. In some embodiments, a bowstring track 21, 31 is deep enough to contain two layers of servicing cable 80. In some embodiments, certain portion(s) of the bowstring track 21, 31 are deep enough to contain two layers of servicing cable 80, while other portion(s) have a depth suitable for one layer of servicing cable 80.

Figure 7:
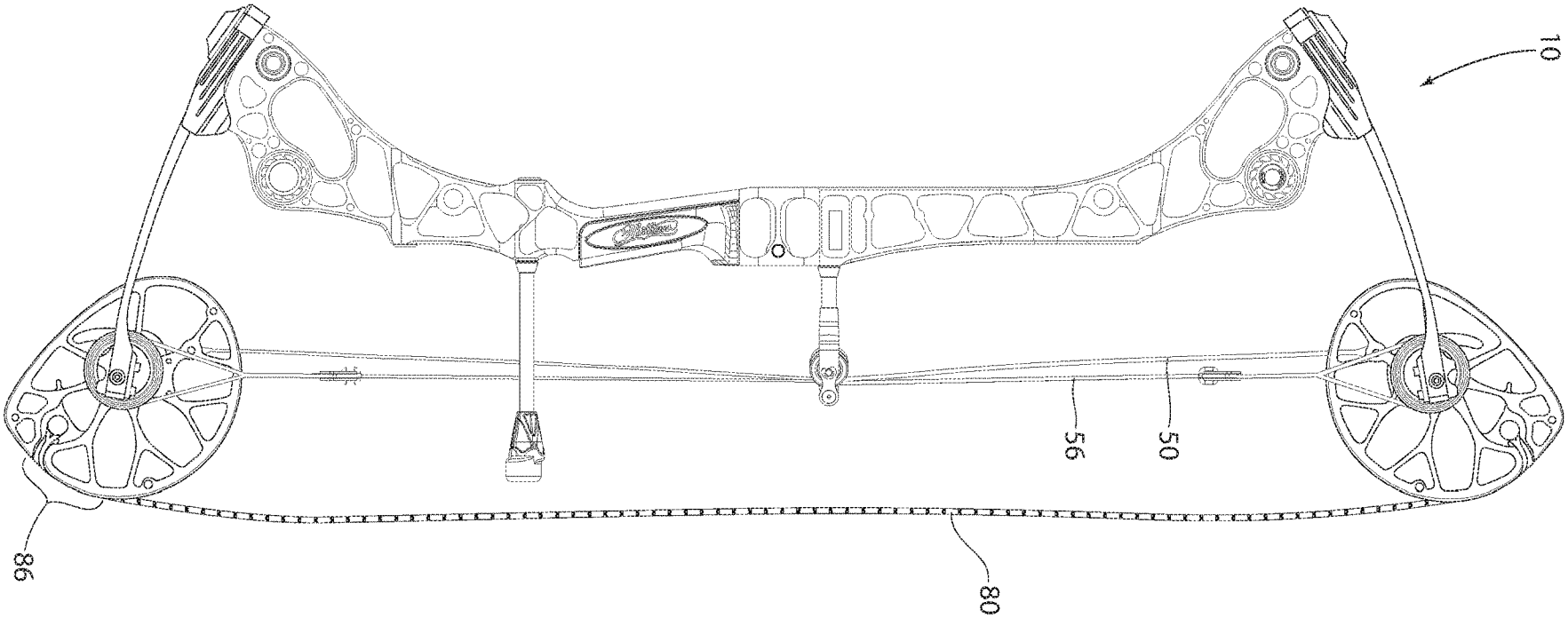

FIG. 7 shows the bow 10 of FIG. 6 with no external force being applied to the servicing cable 80. Desirably, the bow 10 has relaxed sufficiently that the power cable(s) 50, 56 can be removed. The servicing cable 80 can also be removed if desired.

Figure 8:
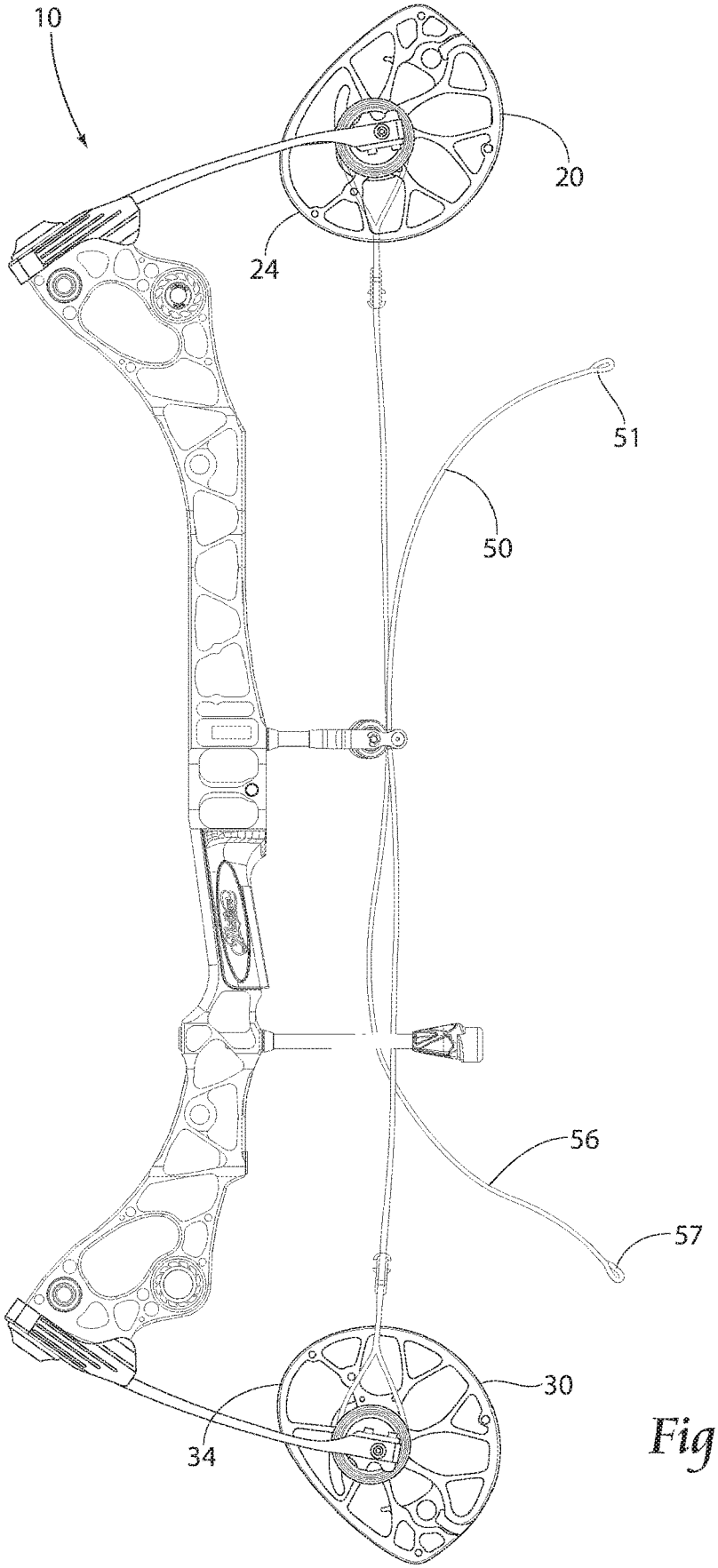

FIG. 8 shows the bow 10 of FIG. 7 after the first end 51 of the first power cable 50 has been detached from the first power cable terminal 24 of the first rotatable member 20, and the first end 57 of the second power cable 56 has been detached from the second power cable terminal 34 of the second rotatable member 30.

The bow 10 is now completely unstrung. The power cables 50, 56 can be removed from the bow 10 entirely and replaced with new power cables 50, 56.

The bow 10 can be strung using a servicing cable 80 and servicing string 70 is a procedure that is essentially reversed when compared to the unstringing process. In some embodiments, when power cables 50, 56 are properly attached to bow 10, the servicing cable 80 can be used to wind the rotatable members 20, 30, thereby loading the bow 10 and flexing the limbs 14, 16. The rotatable members 20, 30 can be wound past their brace orientation to a slightly drawn condition, and the servicing string 70 installed between the rotatable members 20, 30, resulting in a condition as shown in FIG. 4. The servicing cable 80 can be removed and a bowstring 40 can be installed, and the servicing string 70 can be removed, allowing the bow 10 return to its brace condition.

In some embodiments, a servicing string 70 and servicing cable 80 allow an archer to perform a complete unstringing of strings and cables from a bow 10 without the need for any tools. Strings and cables can be replaced in the field, without the need for a bow press or any external components arranged to apply large forces to the bow 10.

Figure 9:
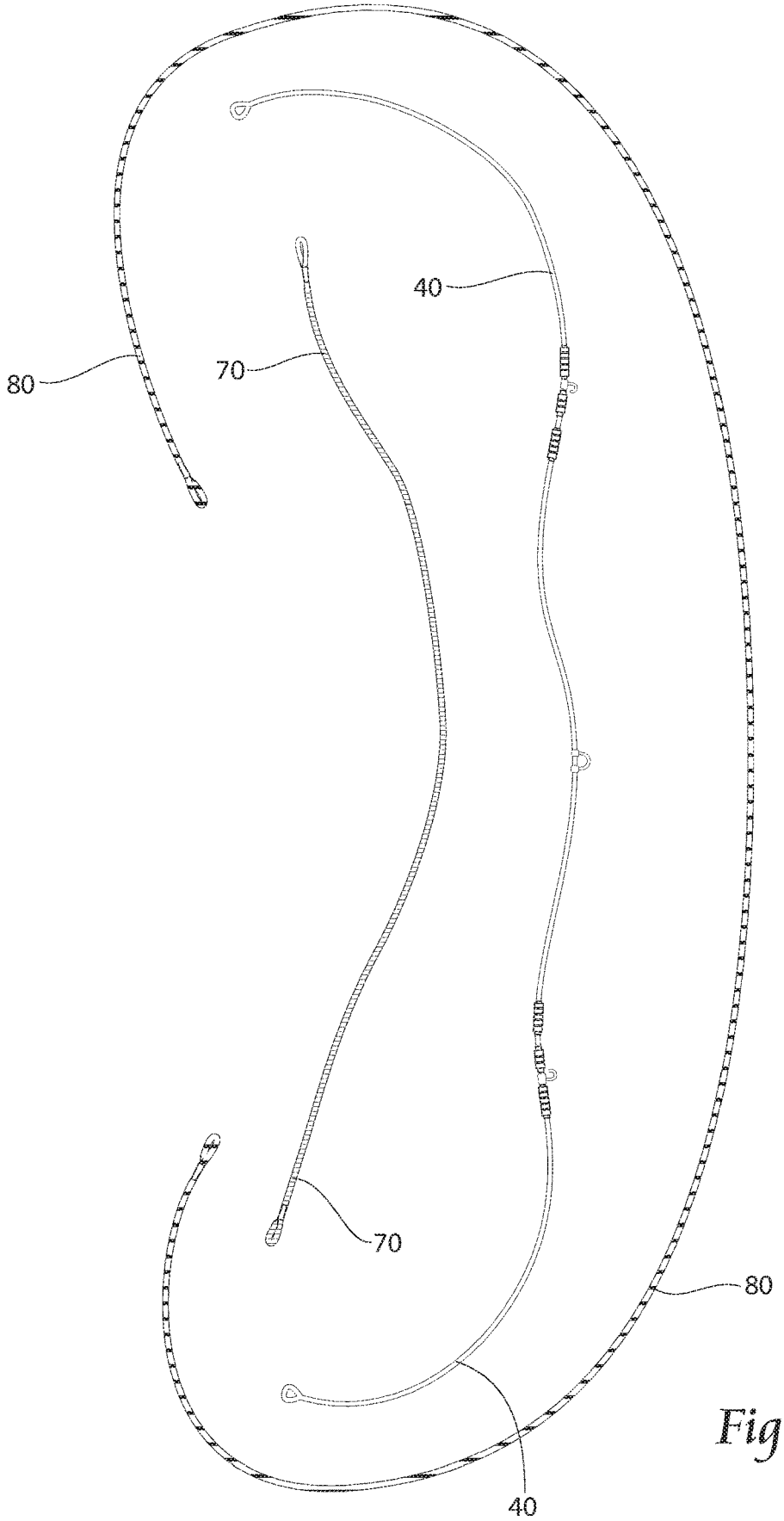
FIG. 9 shows an embodiment of a bowstring along with an embodiment of a servicing string and an embodiment of a servicing cable.

FIG. 9 shows an embodiment of a bowstring 40, an embodiment of a servicing string 70 and an embodiment of a servicing cable 80.

In some embodiments, the bowstring 40 is longer than the servicing string 70 and the servicing cable 80 is longer than the bowstring 40. The specific lengths of the servicing string 70 and the servicing cable 80 may be chosen depending upon the specifics of the bow 10.

Figure 10:
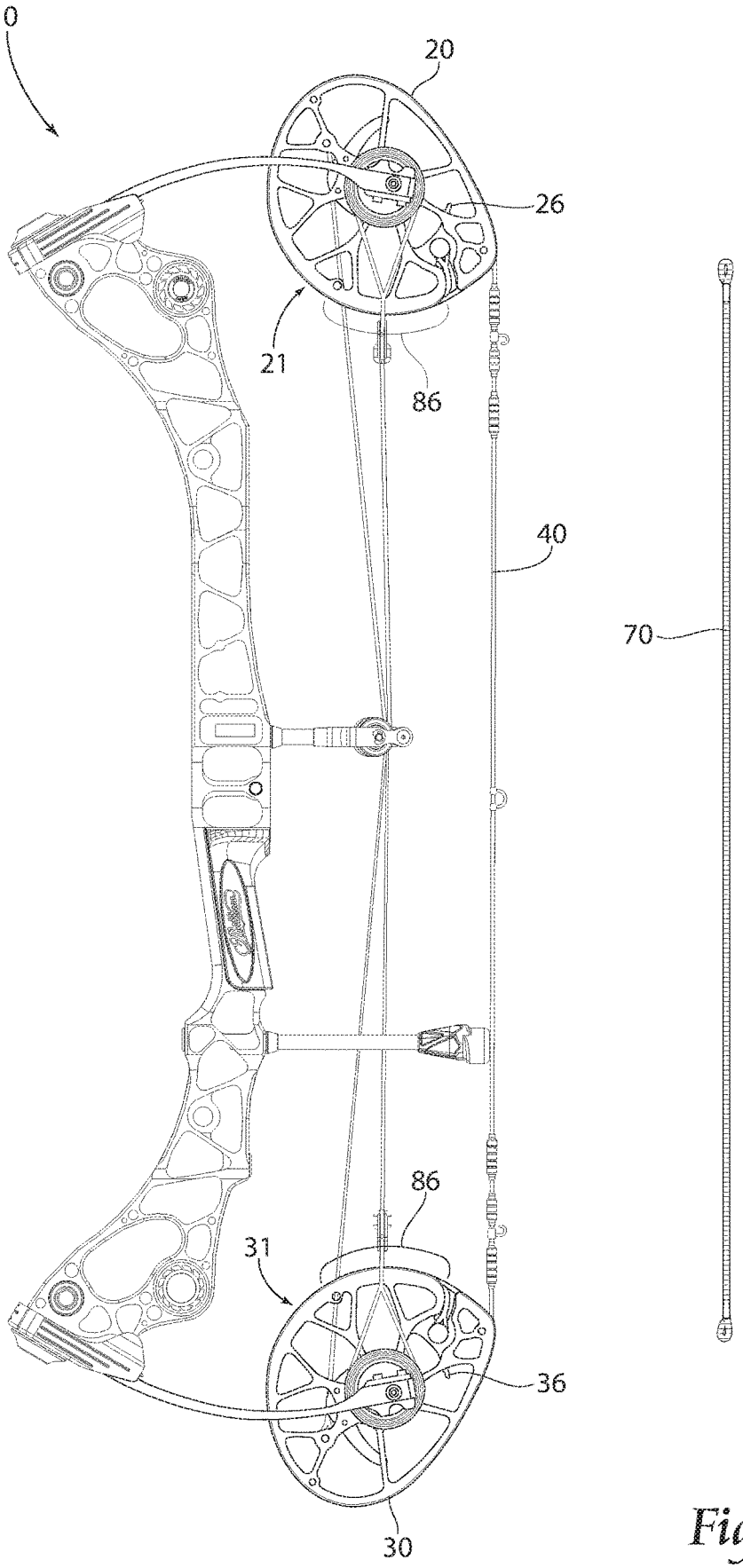
FIG. 10 shows another embodiment of an archery bow.

FIG. 10 shows another embodiment of a bow 10 and an embodiment of a servicing string 70. In some embodiments, a length of the servicing string 70 is less than an axle-to-axle distance of the bow 10. In some embodiments, a length of the servicing string 70 is less than a distance between servicing posts 26, 36 in the brace condition. In some embodiments, a length of the servicing string 70 is greater than a minimum distance between the rotatable members 20, 30 in the brace condition.

The rotatable members 20, 30 shown in FIG. 10 include bowstring tracks 21, 31 having portions 86 that include a depth suitable to contain two layers of servicing cable 80.

In some embodiments, a rotatable member 20, 30 comprises a first terminal arranged to engage a bowstring, a second terminal arranged to engage a first cable, a third terminal arranged to engage a second cable, and a servicing post 26, 36.

In some embodiments, the servicing post 26, 36 of a rotatable member 20, 30 is not attached to a bowstring 40 or power cable 50, 56.

In some embodiments, the servicing string 70 is constructed an arranged to engage a servicing post 26 but configured to not engage terminals or posts provided for the bowstring 40 or power cables 50, 56. For example, in some embodiments, a servicing post 26 is smaller than terminals provided for the bowstring 40 and power cables 50, 56, and the servicing string 70 comprises a loop that will fit around a servicing post 26 but not a terminal provided for the bowstring 40 or a power cable 50, 56.

In some embodiments, the bow 10 comprises a crossbow.

Figure 11:
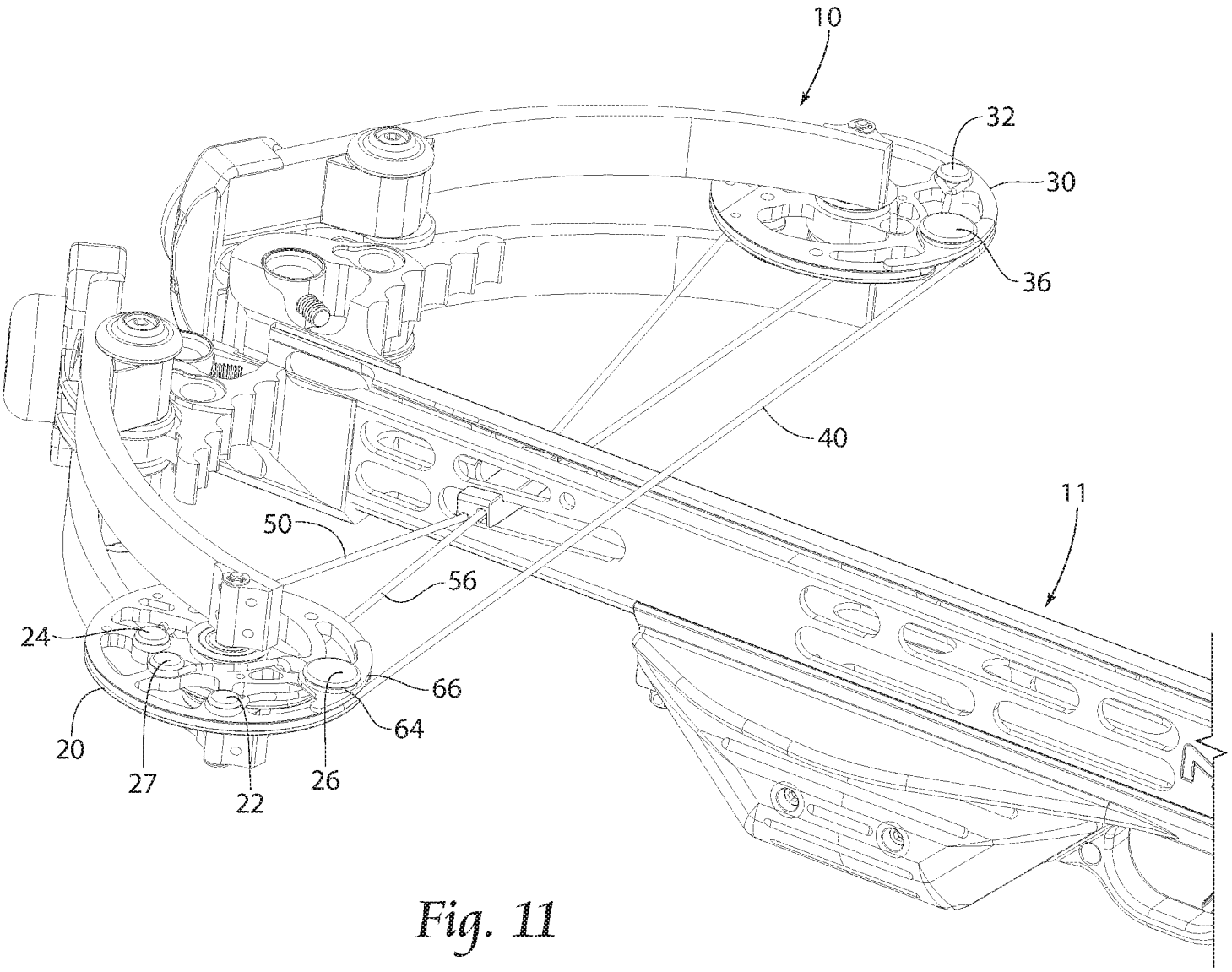
FIG. 11 shows an embodiment of a crossbow.

FIG. 11 shows an embodiment of a crossbow 11 comprising rotatable members 20, 30 that include respective servicing posts 26, 36. A servicing string and a servicing cable can be used to unstring the bowstring 40 and power cables 50, 56 as previously described herein.

In some embodiments, a rotatable member 20 comprises a bowstring terminal 22, a first power cable terminal 24, a second power cable terminal 27 and a servicing post 26.

In some embodiments, a servicing post 26 comprises a stem portion 64 and a flange 66. In some embodiments, the servicing post 26 is constructed and arranged such that a bowstring 40 and/or power cables 50, 56 arranged to engage their respective terminals 22, 24, 27 will be unable to engage the servicing post 26. In some embodiments, a size of the servicing post 26 is larger than terminal loops provided at the ends of the bowstring 40 and/or power cables 50, 56. In some embodiments, a servicing post 26 is larger in size than other terminal posts 22, 24, 27 on the rotating member 20.

In some embodiments, a servicing string and a servicing cable can be configured for use on a single cam archery bow.

Figure 12:
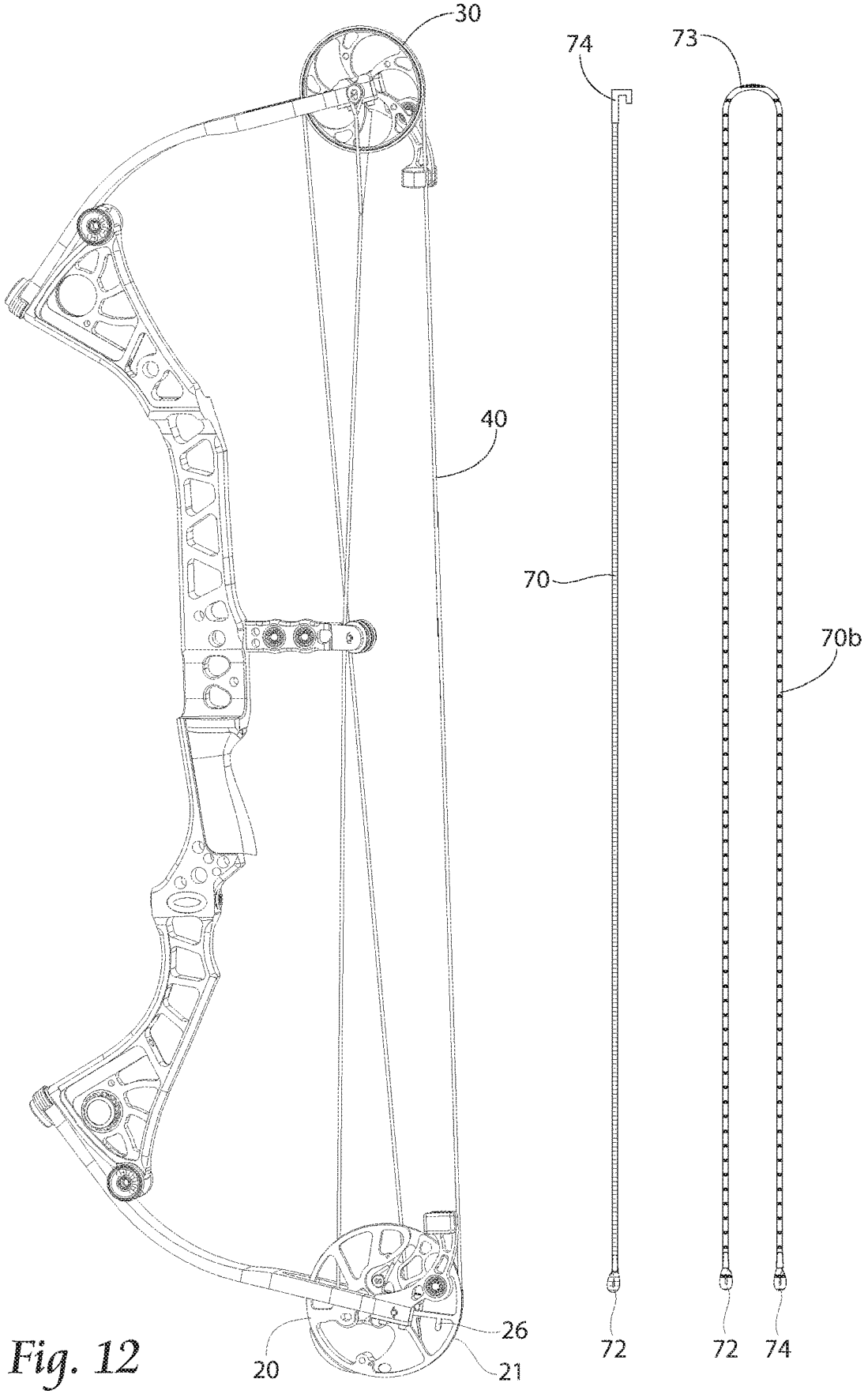
FIG. 12 shows an embodiment of a single cam bow.

FIG. 12 shows an embodiment of an archery bow 10 comprising a first rotatable member 20 comprising a cam track, a primary bowstring track 21 and a secondary bowstring track. A second rotatable member 30 comprises a pulley. In some embodiments, a power cable 50 is arranged to be taken up on the cam track. In some embodiments, the bowstring 40 comprises a first end attached to the first rotatable member 20, an elongate portion that wraps around the second rotatable member 30 and a second end attached to the first rotatable member 20.

In some embodiments, the first rotatable member 20 comprises a servicing post 26.

FIG. 12 shows two embodiments of servicing strings 70 that can be used to unstring the bowstring 40. In some embodiments, a servicing string 70 comprises a first end 72 arranged to engage the servicing post 26 and a second end 74 arranged to engage the second rotatable remember 30. As shown in FIG. 12, the first end 72 comprises a terminal loop suitable to engage the servicing post and the second end 74 comprises a hook suitable to engage the second rotatable member 30. In some embodiments, a length of the servicing string 70 is less than an axle-to-axle distance defined by the archery bow 10.

In some embodiments, a servicing string **70*b* comprises a first end 72 arranged to engage the servicing post 26, an elongate portion 73 arranged to engage the second rotatable member 30, and a second end 74 arranged to engage the servicing post 26. Thus, in some embodiments, both ends of a servicing string 70 engage the same servicing post 26. In some embodiments, the elongate portion 73 can be passed through an aperture in the second rotatable member 30 to engage the second rotatable member 30. In such embodiments, a length of the servicing string 70*b* is greater than an axle-to-axle distance defined by the archery bow 10. The servicing string 70*b* may have a length that is less than the bowstring 40. The arrangement of servicing string 70*b* can also be used in bows configured as shown in FIG. 1**.

A servicing cable (not shown in FIG. 12) can further be used to unwind the first rotatable member 20 and unload the bow 10. For example, a servicing cable that is longer than the bowstring 40 can be installed in place of the bowstring 40, the servicing string 70/**70*b* can be removed and the servicing cable can allow unwinding of the rotatable member(s) 20, 30. When the bow 10 is unloaded, the power cable 50** can be changed.

In some embodiment, the invention is directed to a method as described in the following paragraphs:

1. A method comprising:

attaching a servicing string to a first rotatable member and a second rotatable member of a compound archery bow, wherein the servicing string retains the first rotatable member and the second rotatable member in a non-brace orientation; and removing a bowstring from the compound archery bow.

2. The method of paragraph 1, wherein removing the bowstring comprises detaching the bowstring from the first rotatable member.

3. The method of paragraph 2, wherein removing the bowstring further comprises detaching the bowstring from the second rotatable member.

4. The method of paragraph 1, further comprising installing a replacement bowstring on the compound archery bow.

5. The method of paragraph 4, wherein installing the replacement bowstring comprises attaching the replacement bowstring to the first rotatable member.

6. The method of paragraph 5, wherein installing the replacement bowstring comprises attaching the replacement bowstring to the second rotatable member.

7. The method of paragraph 4, further comprising detaching the servicing string from the first rotatable member.

8. The method of paragraph 7, further comprising detaching the servicing string from the first rotatable member.

9. The method of paragraph 1, wherein the servicing string is shorter in length than the bowstring.

10. The method of paragraph 1, wherein the servicing string is shorter than an axle-to-axle distance of the compound archery bow.

11. The method of paragraph 1, further comprising attaching a servicing cable to the first rotatable member and the second rotatable member.

12. The method of paragraph 11, wherein the servicing cable is longer than the bowstring.

13. The method of paragraph 11, wherein the servicing cable is oriented in a bowstring track of the first rotatable member.

14. The method of paragraph 11, further comprising removing the servicing string.

15. The method of paragraph 14, further comprising allowing the first rotatable member and the second rotatable member to rotate past their brace orientations.

16. The method of paragraph 14, further comprising removing any external force being applied to the servicing cable.

17. The method of paragraph 14, further comprising removing a power cable of the compound archery bow.

18. The method of paragraph 17, further comprising installing a replacement power cable on the compound archery bow.

In some embodiments, an archery bow 10 is configured according to the following numbered paragraphs.

1. An archery bow comprising:

a first rotatable member comprising a body comprising an integrally formed first servicing post and a first bowstring track;

a second rotatable member comprising a body comprising an integrally formed second servicing post and a second bowstring track;

a bowstring extending between the first rotatable member and the second rotatable member; and a servicing string constructed and arranged to engage the first servicing post and the second servicing post;

wherein the first servicing post and the second servicing post are separated by a distance when the bow is in a brace condition, a length of the servicing string being less than said distance.

2. The archery bow of paragraph 1, further comprising a servicing cable, the servicing cable being longer than the bowstring.

3. The archery bow of paragraph 1, wherein the first rotatable member defines a rotation axis, the first servicing post extending in a direction orthogonal to the rotation axis.

4. The archery bow of paragraph 1, wherein the first servicing post is integral portion of the first rotatable member.

5. An archery bow comprising:

a first rotatable member comprising a body comprising an integrally formed first servicing post and a first bowstring track;

a second rotatable member comprising a body comprising a second bowstring track;

a bowstring comprising a first end and a second end, the first end attached to the first rotatable member, the bowstring wrapping around the second rotatable member, the second end attached to the first rotatable member; and a servicing string comprising a first end arranged to engage the first servicing post, an elongate portion arranged to contact the second rotatable member and a second end arranged to engage the first servicing post.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method comprising:

attaching a servicing string to a first rotatable member and a second rotatable member of a compound archery bow, wherein the servicing string retains the first rotatable member and the second rotatable member in a non-brace orientation;

removing a bowstring from the compound archery bow;

attaching a servicing cable to the first rotatable member and the second rotatable member;

detaching the servicing string from at least one of the first rotatable member or the second rotatable member; and letting down the servicing cable.

2. The method of claim 1, wherein detaching the servicing string comprises applying a force to the servicing cable.

3. The method of claim 2, wherein letting down the servicing cable comprises removing the force from the servicing cable.

4. The method of claim 1, wherein letting down the servicing cable comprises rotating the first rotatable member and second rotatable member past their orientations in a brace condition.

5. The method of claim 1, the compound archery bow comprising limbs, wherein letting down the servicing cable comprises unloading the limbs.

6. The method of claim 1, wherein attaching the servicing cable to the first rotatable member comprises attaching the servicing cable to a bowstring terminal post.

7. The method of claim 6, wherein attaching the servicing cable to the first rotatable member further comprises orienting a portion of the servicing cable in a bowstring track.

8. The method of claim 1, comprising removing the servicing cable.

9. The method of claim 1, the compound archery bow comprising a power cable, the method further comprising removing the power cable.

10. The method of claim 9, comprising installing a replacement power cable on the compound archery bow.

11. The method of claim 1, comprising applying a force to the servicing cable, thereby loading the compound archery bow and causing the first rotatable member and the second rotatable member to rotate.

12. The method of claim 11, further comprising attaching the servicing string to the first rotatable member and the second rotatable member.

13. The method of claim 12, comprising removing the servicing cable.

14. The method of claim 13, comprising installing a replacement bowstring on the compound archery bow.

15. The method of claim 13, comprising removing the servicing string.

16. A method comprising:

attaching a servicing string to a first rotatable member and a second rotatable member of a compound archery bow, wherein the servicing string retains the first rotatable member and the second rotatable member in a non-brace orientation;

removing a bowstring from the compound archery bow;

attaching a servicing cable to the first rotatable member and the second rotatable member;

detaching the servicing string from at least one of the first rotatable member or the second rotatable member;

letting down the servicing cable to unload the compound archery bow.

17. The method of claim 16, the compound archery bow comprising a power cable, the method further comprising removing the power cable.

18. The method of claim 17, comprising installing a replacement power cable on the compound archery bow.

19. The method of claim 16, comprising installing a replacement bowstring on the compound archery bow.

* * * * *